US006752694B2

(12) United States Patent
Schneegans et al.

(10) Patent No.: US 6,752,694 B2
(45) Date of Patent: Jun. 22, 2004

(54) APPARATUS FOR AND METHOD OF WAFER GRINDING

(75) Inventors: Manfred Schneegans, Vaterstetten (DE); Michael Roesner, Dresden (DE); David Wallis, Dresden (DE)

(73) Assignees: Motorola, Inc., Schaumburg, IL (US); Semiconductor 300 GmbH & Co.KG, Dresden (DE); Infineon Technologies AG, Munich (DE)

( * ) Notice: Subject to any disclaimer, the term of this patent is extended or adjusted under 35 U.S.C. 154(b) by 0 days.

(21) Appl. No.: 10/290,907

(22) Filed: Nov. 8, 2002

(65) Prior Publication Data

US 2004/0092209 A1 May 13, 2004

(51) Int. Cl.[7] ..... B24B 13/00
(52) U.S. Cl. ..... 451/8; 451/41; 451/288
(58) Field of Search ..... 451/5–10, 41, 451/488, 285–288, 36

(56) References Cited

U.S. PATENT DOCUMENTS

| | | | | |
|---|---|---|---|---|
| 5,035,087 A | * | 7/1991 | Nishiguchi et al. | 451/14 |
| 5,545,076 A | | 8/1996 | Yun | |
| 5,607,341 A | | 3/1997 | Leach | |
| 5,632,667 A | | 5/1997 | Earl | |
| 5,827,111 A | | 10/1998 | Ball | |
| 5,876,265 A | * | 3/1999 | Kojima | 451/10 |
| 5,934,974 A | | 8/1999 | Tzeng | |
| 6,000,996 A | | 12/1999 | Fujiwara | |
| 6,012,967 A | * | 1/2000 | Satake et al. | 451/36 |
| 6,517,668 B2 | * | 2/2003 | Agarwal | 156/345.12 |
| 6,572,444 B1 | * | 6/2003 | Ball et al. | 451/10 |
| 6,633,379 B2 | * | 10/2003 | Roesner et al. | 356/301 |
| 2002/0013120 A1 | * | 1/2002 | Wiswesser et al. | 451/6 |
| 2002/0155789 A1 | | 10/2002 | Bibby, Jr. | |

FOREIGN PATENT DOCUMENTS

WO WO 02/47141 A1 6/2002

OTHER PUBLICATIONS

PCT International Search Report PCT/US03/30589.

* cited by examiner

*Primary Examiner*—Lee D. Wilson
(74) *Attorney, Agent, or Firm*—Kim-Marie Vo

(57) ABSTRACT

An apparatus (10) for wafer grinding includes sensors (38) and a spectral analyzer to perform a spectral analysis of light received by the sensors (38) during grinding of a semiconductor wafer (12). Based on the spectral analysis, the grinding process is stopped or the force applied to the semiconductor wafer is modified. This in situ monitoring decreases breakage and overheating of the semiconductor wafer (12).

18 Claims, 2 Drawing Sheets

FIG. 1
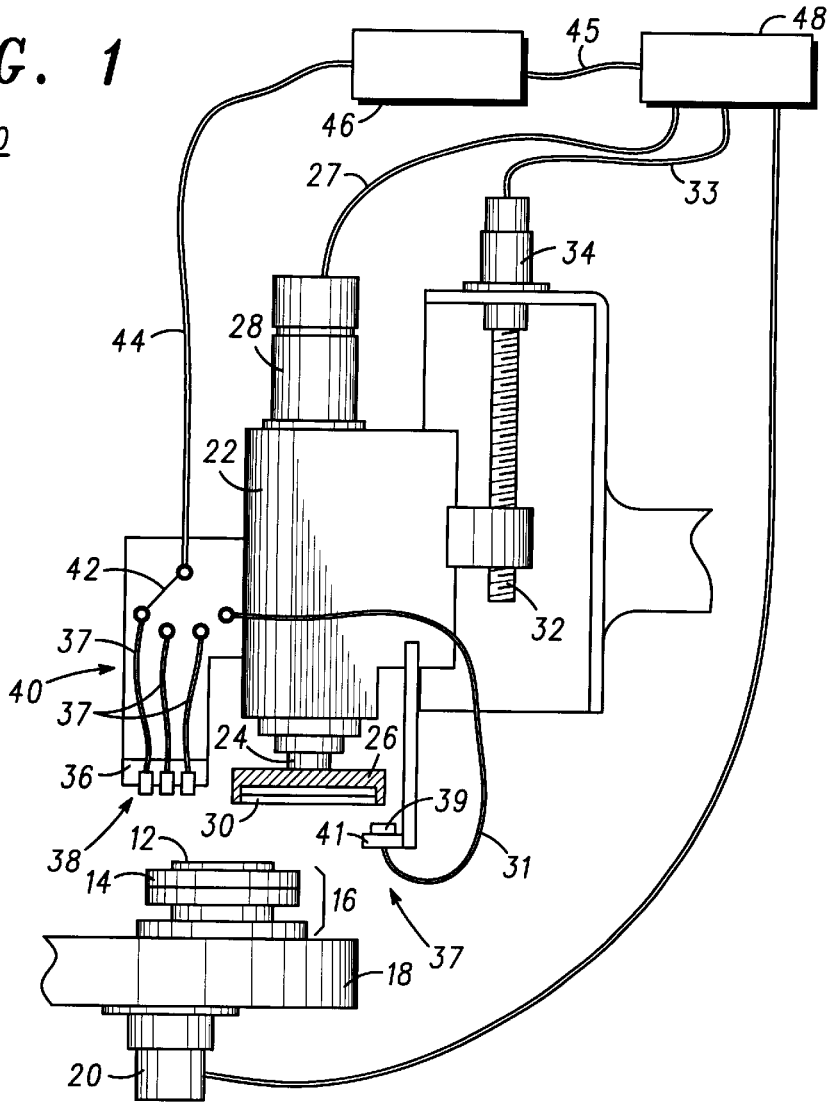
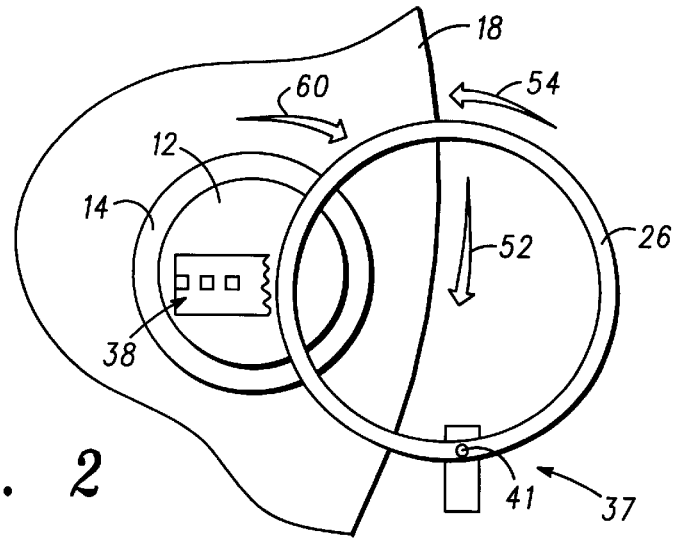
FIG. 2

APPARATUS FOR AND METHOD OF WAFER GRINDING

FIELD OF THE INVENTION

This invention relates generally to semiconductor devices, and more specifically, to wafer grinding semiconductor wafers.

BACKGROUND OF THE INVENTION

As is known, the source material for manufacturing semiconductor devices is usually a relatively large wafer, for example, of silicon. A crystal ingot is sliced to a suitable thickness to obtain a number of nearly disk-shaped wafers. Both surfaces of each wafer are subjected to abrasive machining, and then etched in a suitable mixed acid solution. One surface of each wafer is then polished to obtain a nirror-like surface. Semiconductor devices are formed on the mirror-like surface of the wafer by known processing steps of printing, etching, diffusion, doping, etc.

The silicon wafers are sliced from the crystal ingot to a thickness that is greater than desirable for a finished integrated circuit product to provide a more robust wafer to stand up to the rigors of the fabrication process. Particularly, relatively thick silicon wafers are necessary during fabrication to prevent warpage and breakage of the wafer as a result of certain heating, handling and other fabrication processes. However, the thickness of the wafer after the semiconductor devices are fabricated is greater than desirable for packaging restrictions. Therefore, it is necessary, after forming the semiconductor devices to grind a backside surface of the wafer opposite the front-side surface of the wafer where the semiconductor devices are formed to reduce the wafer thickness.

Suitable grinding machines generally include a plurality of chuck tables that secure a plurality of wafers to be ground by one or more grinding wheels. All of these devices apply a constant feed rate to the grinding wheel, which results in wafer breakage and an overheating. The overheating may burn wafer tape that is formed over the active surface of the wafer to protect it during the grinding operation. Therefore, a need exists for a grinding process or machine that does not break or overheat the semiconductor wafer during grinding.

BRIEF DESCRIPTION OF THE DRAWINGS

The present invention is illustrated by way of example and is not limited by the accompanying figures, in which like references indicate similar elements.

FIG. 1 illustrates a cross-sectional view of a portion of a grinding tool in accordance with an embodiment of the present invention;

FIG. 2 illustrates a top view of a portion of the grinding tool of FIG. 1.

Figure 3:
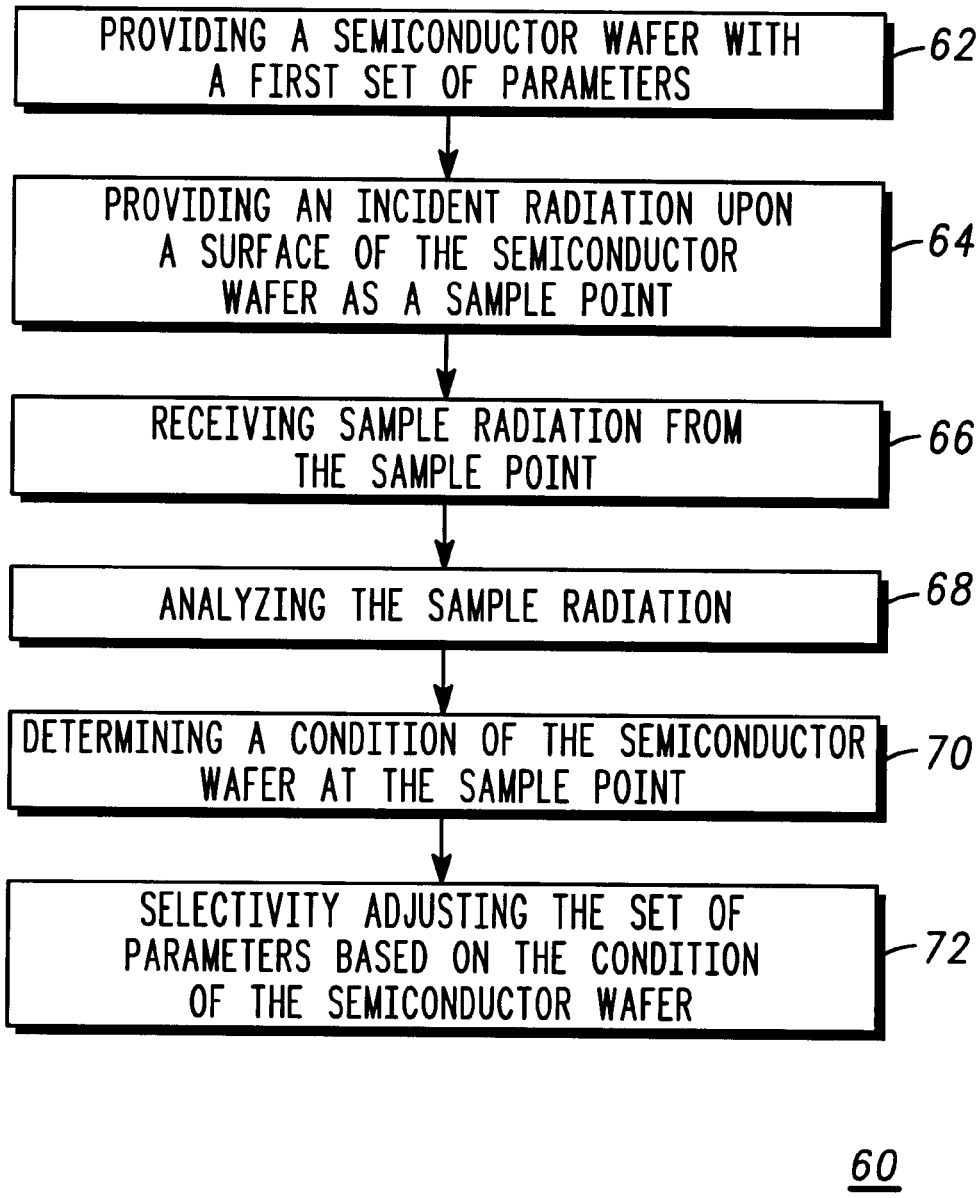
FIG. 3 illustrates a process for monitoring a semiconductor wafer during a semiconductor fabrication process using the grinding tool of FIG. 1 in accordance with an embodiment of the present invention.

Skilled artisans appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention.

DETAILED DESCRIPTION OF THE DRAWINGS

To overcome the problems of the prior art, it is desirable to have a grinding machine that senses the downward force applied to the wafer, and would allow an adjustment of the feed rate in order to maintain a controlled force applied to the wafer. The application of a controlled force would result in a reduction in loading, less wafer breakage, and elimination of the overheating condition.

A process and equipment modification is described which allows for in situ monitoring of a semiconductor wafer or grinding pad during a grinding process. The in situ monitoring can determine when a stress or other damage has occurred in the semiconductor wafer or grinding pad. Because it is an in situ process, the processing can terminate before any additional damage is created or modify processing parameters to mitigate damage. Furthermore, if the semiconductor wafer or grinding pad cannot be salvaged because there is too much damage, the equipment and/or the process can be altered so that no additional wafers are undesirably damaged or stressed. The in situ monitoring controls surface damage to the backside of wafers, allows for in line control of the grinding quality, optimization of the grinding process, and monitoring of the quality of the grinding wheels. Therefore, the in situ monitoring improves the quality and quantity of throughput by the grinding tool.

FIG. 1 illustrates a portion of a grinding tool (material-removing tool) 10, which is part of a grinding system that may have multiple grinding tools, used to grind the backside of a semiconductor wafer 12 (i.e., thin the semiconductor wafer 12). The semiconductor wafer 12 is placed by a robot or manually on a vacuum chuck 14 with the front-side down. Typically, a semiconductor wafer 12 is thinned at the end of manufacturing. Therefore, circuitry exists on the front side of the semiconductor wafer 12 while grinding. To protect the circuitry, a plastic ultraviolet (UV) tape can be adhered via a sticky medium to the front-side of the semiconductor wafer prior to placing the semiconductor wafer 12 on the vacuum chuck 14. After grinding and after the semiconductor wafer 12 is removed from the vacuum chuck 14, in one embodiment, UV radiation is applied to the front-side of the semiconductor wafer 12 to remove the plastic UV tape.

The vacuum chuck 14 is a portion of a grinding chuck 16 and has holes in which a vacuum is pulled to secure the semiconductor wafer 12 to the grinding chuck 16 during grinding. The grinding chuck 16 rests on a turntable 18 that rotates due to a turntable axis 20 controlled by a control unit 48. As will be explained in more detail below, the grinding chuck 16 spins during grinding and the turntable 18 rotates to move the semiconductor wafer 12 between different stations of a grinding system, which includes a plurality of grinding tools 10.

A grinding pad 30 having a material, such as diamond, is attached to a grinding wheel 26. A control unit 48 is coupled to and controls a grinding motor 28, which turns a motor spindle axis 24 and causes the grinding wheel 26 to rotate, via a first fiber 27. A motor housing 22 lies between the grinding motor 28 and the motor spindle axis 24 to contain the mechanical and electrical components that cause the motor spindle axis 24 to spin.

Shown in FIG. 3, is a method 60 for monitoring a semiconductor wafer during a semiconductor fabrication process. In one embodiment, the first step is grinding a semiconductor wafer with a first set of parameters using the grinding tool of FIG. 1. This can be performed by lowering the grinding pad 30 to contact the semiconductor wafer 12 during polishing by a down feed spindle 32 which, in one embodiment, has gears that are complementary to gears attached to the motor housing 22. The down feed spindle 32 is rotated by the down feed spindle motor 34, which is controlled by the control unit 48 via a second fiber 33. Once the grinding pad 30 is touching the semiconductor wafer 12, the force or pressure between the grinding pad 30 and the semiconductor wafer 12 is controlled by turning the down feed spindle 32. For example, to increase the pressure between the grinding pad 30 and the semiconductor wafer 12, the down feed spindle 32 can turn in the same direction it turned to lower the grinding pad 30. Alternatively, turning the down feed spindle 32 in the opposite direction than it was turned to lower the grinding pad 30, decreases the pressure applied to the semiconductor wafer 12. The down feed spindle 32 can also rotate in an opposite direction than it was turned to lower the grinding pad 30 to raise the grinding pad 30 after grinding.

The control unit 48 is also coupled via a third fiber 45 to a laser box 46, which includes a monochromatic radiation (e.g. light) source. In one embodiment, the laser box 46 includes a Nd:YAG laser. The laser box 46 is coupled via a first fiber optic 44 (sensor wiring) to a switching unit 42, which connects the first fiber optic 44 to semiconductor wafer sensors 38 and a grinding pad sensor 39 via second fiber optics 37 and a third fiber optic 31, respectively. In a preferred embodiment, the semiconductor wafer sensors 38 and the grinding pad sensor 39 are Raman sensors. The semiconductor wafer sensors 38 are supported by a first clamping unit 36, to which they are attached, and the grinding pad sensor 39 is attached to and supported by a second clamping unit 41, which is coupled to the motor housing 22.

The second step 64 (providing an incident radiation upon a surface of the semiconductor wafer at a sample point) and a third step 66 (receiving sample radiation from the sample point) of the process 60 of monitoring a semiconductor wafer shown in FIG. 3 can be performed using the grinding tool 10 shown in FIG. 1 as described below. When the switching unit 42, housed in a sensor box 40, connects the first fiber optic 44 to the third fiber optic 31 the monochromatic light from the laser box 46 is emitted from the grinding pad sensor 39 to the grinding pad 30, which reflects the monochromatic light back to the grinding pad sensor 39. Similarly, each of the semiconductor wafer sensors 38 emits incident radiation and receives reflected radiation from the semiconductor wafer 12. In other words, each of the semiconductor wafer sensors 38 illuminate a sample point upon the surface of the semiconductor wafer 12 with radiation and receive a sample light emitted from the first sample point. In a preferred embodiment, at least three semiconductor wafer sensors 38 are used and connected to the sensor box 40 by a claming unit 36.

As shown in FIG. 1, the grinding wheel 26 is not concentric with the semiconductor wafer. Instead, only a portion of the grinding wheel 26 is over the semiconductor wafer 12. To grind the semiconductor wafer 12, the grinding wheel 26 is lowered so that the grinding pad 30 is in contact with only a portion of the semiconductor wafer. Preferably, the overlap of the grinding pad 30 and the semiconductor wafer is at most the radius of the semiconductor wafer 12. The grinding pad 30 and the grinding chuck 16 spins so that all areas of the semiconductor wafer 12 are grinded during processing. However, at any instance of time, a portion of the semiconductor wafer 12 is exposed. It is the exposed portion of the semiconductor wafer 12 from which the semiconductor sensors 38 receive reflected radiation. Therefore, the number of semiconductor sensors 38 may vary depending on the size of the semiconductor wafer, since the exposed portion of the semiconductor wafer will increase as the semiconductor wafer diameter increases.

In one embodiment, three semiconductor wafer sensors 38 are used so that a first semiconductor wafer sensor is at or near the center of the semiconductor wafer 12, a second semiconductor wafer sensor is near the edge of the semiconductor wafer 12, and a third semiconductor wafer sensor is in between the first sensor and the second sensor. In a preferred embodiment, the semiconductor wafer 12 has a diameter of 300 mm, the first semiconductor wafer sensor 38 is over the center of the semiconductor wafer 12, the second semiconductor wafer sensor 38 is 7 centimeters from the center, and the third semiconductor wafer sensor 38 is 14 centimeters from the center. In one embodiment, there are at least 3 sample points evenly distributed along the radius of the semiconductor wafer 12. However, a skilled artisan recognizes that any number or configuration of semiconductor wafer sensors 38 can be implemented. As shown in FIG. 1, only one grinding pad sensor 39 is illustrated, but any number or configuration of grinding pad sensors 39 may be used. (Only one grinding pad sensor 39 is shown, because monitoring the grinding pad 30 may not be as important as monitoring the semiconductor wafer 12 and therefore, not as many sensors are needed.)

The reflected radiation received by the semiconductor sensors 38 or the grinding pad sensor 39 can be collected by a computer (not shown) via the control unit 48, for example, and analyzed as shown in a fourth step (analyzing the sample radiation) of the process 60 for monitoring a semiconductor wafer in FIG. 3. In one embodiment, the computer includes a spectral analyzer for performing a spectral analysis of the sample light received by each of the semiconductor wafer sensors 38 and determines the condition of the semiconductor wafer at each of the sample points based on a spectral analysis of the sample points. In one embodiment, a Raman spectral analyzer is used to provide Raman spectrum information of the sample light. The shift in the wavelength of the reflected light relative to the incident light is the Raman shift and correlates to damage, such as stress (warpage) or microcracks, in the semiconductor wafer 12 or grinding pad 30. In other words, a condition of the semiconductor wafer at the sample point is determined as shown in a fifth step of the process 60 of FIG. 3. For example, if the semiconductor wafer 12 is silicon, light with a wavelength of 500 nanometers may be emitted from the laser box 46 and incident on the semiconductor wafer 12. If the reflected light has a wavelength greater than (a predetermined criteria) 500 nanometers (e.g. 505 nanometers) then it is known that a tensile stress is present. Similarly, if the reflected light has a wavelength less than 500 nanometers (e.g. 495 nanometers), then a compressive stress is present in the semiconductor wafer 12. The magnitude of the stress is important for determining when grinding should terminate or other process parameters should be altered (e.g., the pressure applied to the semiconductor wafer 12 should be decreased or increased.) If the stress or any other condition is not within a predetermined range or meets a predetermined condition, the process parameters may be adjusted. Since the process parameters are not automatically adjusted they are selectively adjusted. Hence, the set of parameters are selectively adjusted based on the condition of the semiconductor wafer as shown in a sixth step 72 of FIG. 3.

The monitoring of the magnitude of the stress of the semiconductor wafer 12 is, preferably, in situ. To be able to determine the stress during processing, a database or table is prepared prior to processing. In one embodiment, test wafers, all having the same semiconductor wafer material, are processed using the same grinding tool 10. The wavelength of the reflected light upon completion of the grinding process is monitored. The stress of the semiconductor wafer 12 after processing is measured in the grinding tool or using a different tool according to the following equation:

$$\sigma_{wfr}=(T_{bow})/(T_{wfr})^2,$$

where $\sigma_{wfr}$ is the wafer stress, $T_{bow}$ is the thickness of the bow of the semiconductor wafer 12, and $T_{wfr}$ is the thickness of the wafer. Generally, the higher the bow the higher the stress. If the value for the bow is positive, then the stress in the semiconductor wafer 12 is tensile, and if the value for the bow is negative, then the stress in the semiconductor wafer 12 is compressive.

A datasheet, table, software program, or the like is made that correlates the calculated wafer stress with the reflected light from the semiconductor wafer 12. Therefore, during processing for a given reflected radiation, the corresponding stress can be found using the datasheet, the table, the software program or the like. When the stress is found to be outside a range of stresses, then the tool should be adjusted (e.g. the pressure between the grinding pad 30 and the semiconductor wafer 12 should be decreased.) In one embodiment, the range of desired stress is less than 100 MegaPascals or more specifically, between 50 to 100 MegaPascals.

In one embodiment, if the stress is outside a range of predetermined stresses or is not a predetermined value, a warning signal is provided by the grinding system. The grinding system may also include a display, such as a CRT (cathode ray tube) display or monitor for displaying an image of an area of the semiconductor wafer 12 that is illuminated during in situ monitoring.

The reflected radiation from the semiconductor wafer 12 can be a single wavelength or a spectrum of wavelengths, such as a Raman spectrum. In the embodiment where a single wavelength is received from the reflecting radiation, a single wavelength was used as the incident radiation. This embodiment would be used in a situation where the characteristic wavelength of the material that is being analyzed is known. For example, it is known that for a silicon semiconductor wafer a wavelength of approximately 500 nanometers will yield results for a Raman spectrum analysis. However, if the particular wavelength for the material being analyzed is not known, a wide range of wavelengths can be tested. In this embodiment a spectrum of information will be collected from the reflecting radiation. In this embodiment, a graph of reflectance versus wavelength can be generated. The spectrum information could include intensity, position, polarization, or widths of RAMAN spectral lines. Any one of these pieces of information can be used as the characteristic of the material being analyzed. Any change from this spectrum could be used to determine if stress if present in the material. For example, the width of a spectrum at a given wavelength can be studied and whether this width increases or decreases may change due to stress. Therefore, this could be the characteristic of the wavelength that is analyzed in regard to stress and monitored during processing.

FIG. 2 illustrates portions of the grinding tool 10 of FIG. 1 from a top view. More specifically, FIG. 2 illustrates the grinding wheel 26, the semiconductor wafer 12, and all support structures such as the vacuum chuck 14, semiconductor wafer sensors 38, grinding pad sensor 39, and the associated clamping unit 41. The grinding wheel 26 is over a portion of the semiconductor wafer 12. Therefore, there is an exposed portion of the semiconductor wafer 12 that the semiconductor wafer sensors 38 are monitoring. During grinding, the grinding wheel 26, which includes the grinding pad 30 (not shown in FIG. 2), moves in a counterclockwise rotation shown by a first arrow 54. In this embodiment, the semiconductor wafer 12 moves clockwise during grinding. After processing is completed, the grinding wheel 26 is raised and the turntable 18 is rotated, for example, in a clockwise direction as shown by a second arrow 52 in FIG. 2. The turntable 18 is rotated so that the semiconductor wafer 12 is moved to a different station on the grinding system.

In a preferred embodiment the grinding process is a two-step process. First, the semiconductor wafer 12 is placed on the vacuum chuck 14 and rotated so that a portion of the semiconductor wafer 12 is aligned underneath a first grinding pad 30. Next, the grinding wheel 26 is moved downward so that the grinding pad 30 is in contact with the semiconductor wafer 12. As previously discussed, the down feed spindle 32 controls this movement. Next, the grinding pad 30 is rotated in one direction as shown by arrow 54 and the semiconductor wafer 12 is rotated in a different direction as shown by arrow 60. Water may be added in order to serve as a lubricant, to provide cooling, and/or to clean off exposed areas of the semiconductor wafer, which may include particles from the grinding process. This first process performed is a fast removal of the semiconductor wafer material and therefore decreases the semiconductor wafer 12 thickness rapidly. In one embodiment, 750 micrometers to 300 micrometers of silicon is removed. This process causes much damage to the backside of the semiconductor wafer 12

Next, to remove any damage that has been created by the first grinding step, a low damage grinding process needs to be performed. In order for this to occur a different condition (s) (e.g., materials, roughness, etc.) of the grinding pad is used (i.e., another grinding pad is used). To avoid having to replace the grinding pad 30 between the two steps, the semiconductor wafer 12 is moved to a different station, which is similar to the grinding tool 10 of FIG. 1, of a grinding system. To do so, the first grinding pad 30 is lifted so it is no longer in contact with the semiconductor wafer 12. This can be performed by the down-feed spindle 32 moving the grinding pad 30 upward. The turntable 18 is then rotated so that the semiconductor wafer is underneath a different grinding pad.

Although the second grinding pad may be the same material as the first grinding pad (e.g., a diamond material), the coarseness of the pads will differ. For example, for the fast process (i.e., the first process) a very coarse grinding pad will be used which will create defects and for the low damage process (i.e., the second process) a much finer pad will be used. The second grinding pad is attached to a second grinding wheel 26 just like the first grinding pad 30. Again, the second grinding pad is rotated in one direction while the semiconductor wafer 12 is rotated in a different direction.

During both the first and second grinding processes, the sensors 38 can be used to sense the semiconductor wafer 12. However, since the first process is know to create much damage, it may not be necessary to monitor the stress in the first semiconductor wafer during this process. The second process is the low damage process and removes almost, if not all, of the damage from the first process and, therefore, it is important that the stress of the semiconductor wafer 12 is monitored as previously described during at least the second process. In one embodiment, the second process will end once the stress of the semiconductor wafer is within the desired regime that as described above could be between 50 and 100 MegaPascals. In another embodiment, the pressure between the grinding pad 30 and the semiconductor wafer 12 is increased or decreased. The latter case prevents breakage of the semiconductor wafer 12 and the former situation may be needed to ensure the grinding does not take too long and adversely effect cycle time without the risk of the semiconductor wafer 12 breaking if more force is applied.

The second process uses a smooth grinding pad to remove any damage that was created during the first process. Generally, the semiconductor wafer 12 and/or the grinding pad 30 rotate slower than during the first grinding step. In on embodiment, only 300 micrometers to 200 micrometers may be removed. After grinding there may be an additional cleaning step which washes away any of the dust or debris that is generated during the grinding process.

As described above, the semiconductor wafer can be monitored in order to determine the stress in the semiconductor wafer. This information can determine when the grinding process should be completed as well as, to determine when parameters of the grinding tool 10 should be changed. By monitoring the grinding pad 30, it can be determined as to when it is necessary for the grinding pad 30 to be replaced because it is worn. By using the grinding pad sensor 39 additional information can be gained as to the stress of the grinding pad 30 which could better determine when the grinding pad should be replaced.

By in situ monitoring of the stress in the semiconductor wafer and/or the grinding pad during the grinding process, any parameters or conditions of the process that need to be changed in order to achieve desired results can be quickly determined. This prevents many wafers from being processed that later need to be thrown away (scrapped) or reprocessed. Since this grinding process to thin the back side of the wafer occurs generally as one of the last steps in the wafer fabrication process, it is extremely costly to have damaged wafers that need to be scrapped because much time and materials have been spent processing the circuitry on the semiconductor wafer 12. In addition, in situ monitoring prevents test wafers from having to be run in between processing steps. By running test wafers, not only are extra wafers used, which increases the cost of manufacturing, but also the tool is not available to be used to process (production) wafers. Therefore, (production) wafers may have to wait for the test wafers to be processed and the results calibrated. This undesirably decreases cycle time. Therefore, in situ monitoring not only decreases cost but also decreases cycle time and can help increase yield.

Monitoring the stress of the semiconductor wafer 12 during grinding also decreases the chances that the wafer will break during grinding. This can occur if the stress is too great. Again, if the semiconductor wafer 12 is destroyed during the grinding process this creates a yield impact as well as a high cost impact because the semiconductor wafer 12 have already been processed to form active circuitry.

A skilled artisan should recognize that the grinding process and monitoring of the stress can be used with any wafer size and that the described process is not limited to a specific grinding tool. Furthermore, other parameters besides the stress of the semiconductor wafer can be monitored. For example, scratches, microcracks, temperature and contamination of the semiconductor wafer can be monitored in situ using the process previously explained.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. In addition, benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a nonexclusive inclusion, such that a process, method, article, or apparatus that comprises a list of elements does not include only those elements but may include other elements not expressly listed or inherent to such process, method, article, or apparatus. The terms a or an, as used herein, are defined as one or more than one. The term plurality, as used herein, is defined as two or more than two. The term another, as used herein, is defined as at least a second or more.

Moreover, the terms front, back, top, bottom, over, under and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

We claim:

1. A semiconductor processing apparatus comprising:

a material-removing tool for removing material from a wafer;

means for illuminating a sample point upon a surface of the wafer using radiation;

means for receiving sample radiation emitted from the sample point;

means for performing a spectral analysis of the sample radiation received;

means for determining a condition of the wafer at the sample point using the spectral analysis of the sample radiation; and a switch for selectively coupling the sample light to the spectral analyzer.

2. The semiconductor processing apparatus of claim 1, wherein the spectral analyzer is a Raman spectral analyzer for providing Raman spectrum information of the sample light.

3. The semiconductor processing apparatus of claim 2, wherein the Raman spectrum information comprises a condition of Raman spectral lines selected from the group consisting of: intensity, position, polarization, and widths.

4. The semiconductor processing apparatus of claim 1, wherein the condition of the wafer comprises at least one condition criteria of the group consisting of: stress, scratches, microcracks, temperature and contamination.

5. The semiconductor processing apparatus of claim 1, further comprising a means for providing a warning signal if a predetermined condition criteria value is reached.

6. The semiconductor processing apparatus of claim 1, further comprising a display means for displaying an image of an area being illuminated.

7. A method for monitoring a semiconductor wafer comprising:

grinding a semiconductor wafer with a set of parameters;

providing an incident radiation upon a surface of the semiconductor wafer at a sample point while grinding the semiconductor wafer;

receiving sample radiation emitted from the sample point;

determining a condition of the semiconductor wafer at the sample point using the sample radiation;

selectively adjusting the set of parameters based upon the condition of the semiconductor wafer; and providing a warning signal if the condition meets a predetermined criteria.

8. The method of claim 7, wherein selectively adjusting the set of parameters comprises increasing the pressure applied to the semiconductor wafer.

9. The method of claim 7, wherein adjusting the set of parameters comprises decreasing the pressure applied to the semiconductor wafer.

10. The method of claim 7, wherein adjusting the set of parameters comprises terminating grinding the semiconductor wafer.

11. The method of claim 7, wherein analyzing the sample radiation comprises determining a shift in a wavelength of the incident radiation and the sample radiation.

12. The method of claim 11, wherein determining the condition of the semiconductor wafer further comprises determining a stress of the semiconductor wafer.

13. The method of claim 7 further comprising grinding the semiconductor wafer with the adjusted set of parameters.

14. The method of claim 7, further comprising analyzing the sample radiation.

15. The method of claim 7, wherein the condition of the semiconductor wafer is stress of the semiconductor wafer.

16. The method of claim 7, wherein selectively adjusting the set of parameters comprises adjusting the set of parameters when the condition is outside a predetermined range.

17. The method of claim 7, wherein selectively adjusting the set of parameters comprises adjusting the set of parameters when the condition meets a predetermined criteria.

18. A method for monitoring a semiconductor wafer comprising:

grinding a semiconductor wafer with a set of parameters;

providing an incident radiation upon a surface of the semiconductor wafer at a sample point while grinding the semiconductor wafer;

receiving sample radiation emitted from the sample point;

determining a stress of the semiconductor wafer at the sample point using the sample radiation;

monitoring the stress of the semiconductor wafer;

selectively adjusting the set of parameters based on the stress of the semiconductor wafer; and providing a warning signal if the stress meets a predetermined criteria.

* * * * *